US005126005A

United States Patent [19]

Blake

[11] Patent Number: 5,126,005

[45] Date of Patent: Jun. 30, 1992

[54] PROCESS FOR ELIMINATING PITS DURING CHEMICAL MILLING

[75] Inventor: Donald R. Blake, Wichita, Kans.

[73] Assignee: The Boeing Company, Seattle, Wash.

[21] Appl. No.: 576,211

[22] Filed: Aug. 31, 1990

[51] Int. Cl.[5] ..... B44C 1/22; C23F 1/02; B29C 37/00

[52] U.S. Cl. ..... 156/630; 156/634; 156/661.1; 156/665; 156/668

[58] Field of Search ..... 156/630, 633, 634, 651, 156/652, 656, 659.1, 661.1, 665, 668

[56] References Cited

U.S. PATENT DOCUMENTS

| | | | |
|---|---|---|---|
| 3,317,320 | 5/1967 | Reber | 156/661.1 X |
| 3,506,441 | 4/1970 | Gottfried | 156/661.1 X |
| 4,053,351 | 10/1977 | DeForest et al. | 156/661.1 |
| 4,113,549 | 9/1978 | Brimm | 156/639 |
| 4,137,118 | 1/1979 | Brimm | 156/345 |
| 4,284,468 | 8/1981 | Stearns | 156/661.1 |
| 4,588,474 | 5/1986 | Gross | 156/659.1 |
| 4,662,984 | 5/1987 | Ohtake et al. | 156/637 |
| 4,689,114 | 8/1987 | Ohtake et al. | 156/644 |

*Primary Examiner*—William A. Powell
*Attorney, Agent, or Firm*—Finnegan, Henderson, Farabow, Garrett & Dunner

[57] ABSTRACT

A process for chemically milling an airplane skin having inside and outside surfaces, comprising the steps of applying a maskant layer to both the inside and outside surfaces of the skin, adhering a layer of plastic film on top of the maskant layers, selectively removing the plastic film and maskant from areas of the inside surface where chemical milling is desired, immersing the skin in a chemical bath for etching the areas of the inside surface not covered by the plastic film and maskant, and removing the plastic film and maskant from both the inside and outside surfaces.

7 Claims, 3 Drawing Sheets

PROCESS FOR ELIMINATING PITS DURING CHEMICAL MILLING

BACKGROUND OF THE INVENTION

1. Field of the Invention

The present invention relates to a process for chemically milling an airplane skin or other component, which eliminates pitting of the surfaces during etching.

2. Description of Related Art

Traditionally, mechanical machining techniques were used to manufacture structures for the aircraft and aerospace industries. However, these mechanical techniques prevented the formation of lightweight complex structures. Chemical milling was developed to overcome the problems associated with the mechanical techniques.

In conventional chemical milling procedures, the workpiece is masked to prevent overall damage, the maskant is then removed from certain areas of the workpiece and the workpiece is exposed to an etching solution so that the unexposed areas of the workpiece are dissolved, thus shaping the workpiece. However, during masking bubbles and other defects are formed on the surfaces creating pin holes in the maskant through which the etching solution can attack the surface of the workpiece causing pitting. These pits cause unsatisfactory variations in the workpiece surfaces, resulting in scrap.

U.S. Pat. Nos. 4,113,549 and 4,137,118 disclose a chemical milling method which consists of a plurality of masking, removal and etching steps. Initially, the entire surface is masked, certain areas of masking are removed and the workpiece is etched. Next, the workpiece is remasked and other areas of the masking are removed and the workpiece is etched again. This continues until the desired configuration is formed In attempt to prevent pitting, the process rotates the workpiece during etching. However, the above process, like other conventional processes, does not provide a protective layer of film to insure that the maskant layer of the workpiece is protected and etching solution does not reach the workpiece surface to form pits therein.

U.S. Pat. No. 4,588,474 discloses a conventional process for chemical etching and various compositions of etches used therein. Like the above references, no means is provided to protect the maskant layer, and ultimately the workpiece from pitting.

U.S. Pat. Nos. 4,662,984 and 4,689,114 disclose the use of applying protective layers on top of resist films. In the process resist films are applied to almost the entire area of the inner and outer surfaces of a metal plate. Next, a protective layer of film is applied on a first surface, while etching solution is sprayed on a second surface. After etching is completed on the second surface, a second protective film layer is applied on the etched second surface and the first protective film is removed from the first surface. Finally, etching solution is sprayed on the unprotected first surface to form the work piece. The process does not contemplate the use of a plastic layer of film disposed on top of a maskant to prevent pitting of a workpiece.

The improved chemical milling process of the present invention produces a pit-free workpiece despite any defects in the maskant layer. Production time and expense can be reduced without the waste of expensive workpieces.

Advantages of the invention are set forth in part in the description which follows, and in part will be obvious from the description, or may be learned by practice of the invention.

SUMMARY OF THE INVENTION

In accordance with the invention, as embodied and broadly described herein, a process for chemically milling an airplane skin having inside and outside surfaces, comprising the steps of applying a maskant layer to at least one of the inside and outside surfaces of the skin adhering a layer of plastic film on top of the maskant layers, selectively removing the plastic film and maskant from areas of the masked surface where chemical milling is desired, immersing the skin in a chemical bath for etching the areas of the masked surface not covered by the plastic film and maskant, and removing the plastic film and maskant from the masked surface.

As embodied and broadly described herein, the invention also comprises a skin having inside and outside surfaces, the inside surface having etched areas manufactured by a process comprising the steps of applying a maskant layer to both the inside and outside surfaces of the skin, adhering a layer of plastic film on top of the maskant layers, selectively removing the plastic film and maskant from areas of the inside surface where chemical milling is desired, immersing the skin in a chemical bath for etching the areas of the inside surface not covered by the plastic film and maskant, and removing the plastic film and maskant from both the inside and outside surfaces.

Preferably, the plastic film is polytetrafluoroethylene.

In an alternative embodiment, a process for chemically milling a component having inside and outside surfaces, comprising the steps of applying a maskant layer to one the inside or the outside surfaces of the component, adhering a layer of plastic film on top of the maskant layer, selectively removing the plastic film and maskant from areas of the surface where chemical milling is desired, immersing the component in a chemical bath for etching the areas of the surface not covered by the plastic film and maskant, and removing the plastic film and maskant from the inside or outside surface.

It should be understood that both the foregoing general description and the following detailed description ar exemplary and explanatory only and are not limited by the invention as claimed.

BRIEF DESCRIPTION OF THE DRAWINGS

The accompanying drawings, which are incorporated in and constitute a part of this specification, illustrate embodiments of the invention and together with the description, serve to explain details, features and advantages of the invention.

DESCRIPTION OF THE PREFERRED EMBODIMENT

Reference will now be made in detail to the present preferred embodiment of the invention, an example of which is illustrated in the accompanying drawings.

Figure 1:
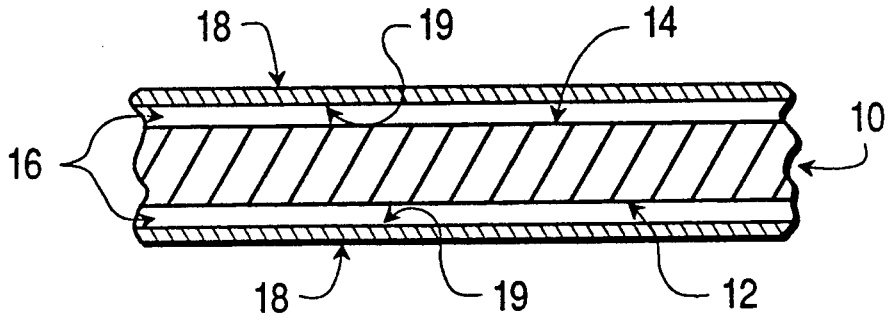
FIG. 1 is a sectional view of the airplane skin, maskant and plastic film formed by the process of the present invention.
Figure 3:
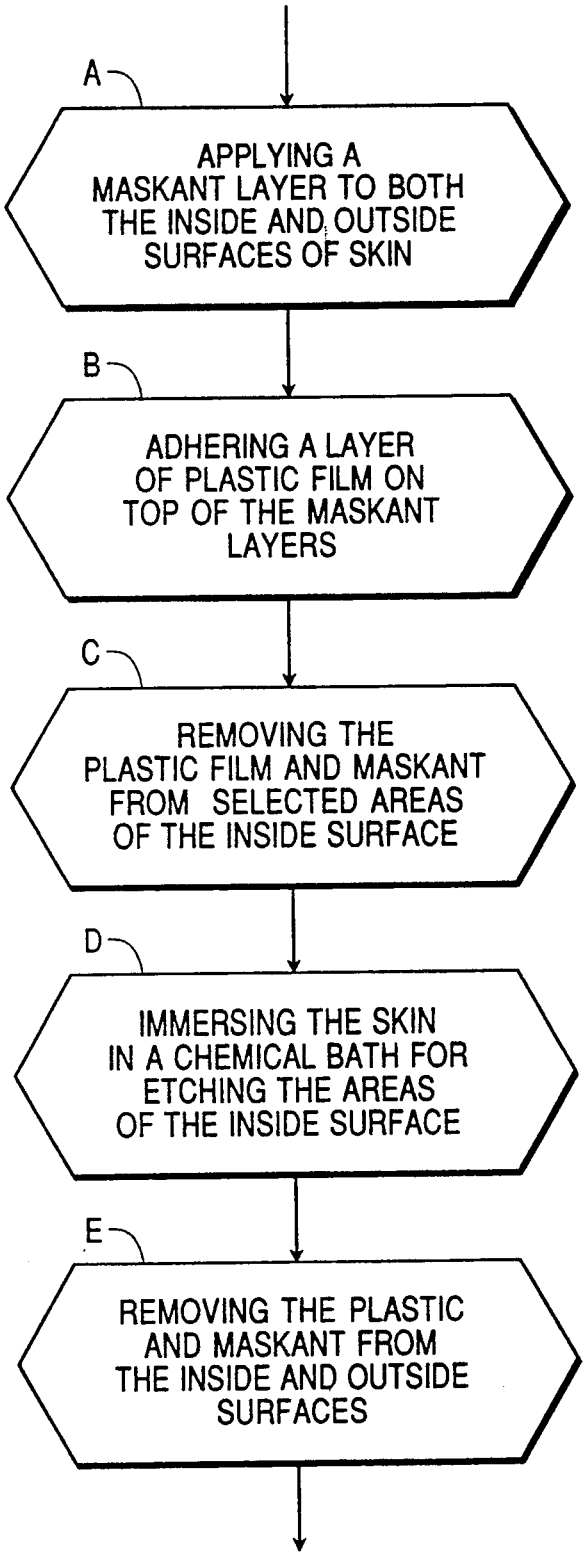
FIGS. 3(A–E) show a flow diagram of the process of the present invention.

In accordance with the invention, a process for chemically milling an airplane skin having inside and outside surfaces, comprising the steps of applying a maskant layer to both the inside and outside surfaces of the skin. As embodied herein and depicted in FIGS. 1 and 3, step A, an airplane skin 10 has inside surface 12 and outside surface 14 to which a layer of maskant 16 is applied. The skin 10 is preferably aluminum, however, various other metal alloys can be treated.

The maskant layer, for example, Adcoat 850, manufactured by A. C. Products Inc., and is applied in a conventional manner, such as dipping, spraying or flow coating. Prior to applying the maskant, the skin should be clean and dry to prevent surface unevenness.

In accordance with the invention, the process includes the step of adhering a layer of plastic film on top of the maskant layers. As depicted herein and embodied in FIGS. 1 and 3, step B, a layer of plastic film 18 is adhered to the maskant layers 16.

Preferably, the plastic film is polytetrafluoroethylene, such as Wrightlon 4600, produced by Air Tech International, and is etching resistant due to a limited amount or virtually no pores. However, other the inventive process should contemplate the usage of other appropriate materials.

In order to facilitate bonding, the plastic film has one bondable side 19 disposed adjacent the maskant layer. The maskant 16 is covered with a 0.003 inch thickness of film 18. After the film is applied heat and pressure are applied to the skin to further bind the film 18 to maskant 16. A stack of film covered skins can be treated in a conventional autoclave and then separated after bonding is completed. The layers of film act to separate the skins, therefore making it possible to autoclave a plurality of skins simultaneously. In contrast, prior art processes incorporated separators when autoclaving a plurality of panels.

Figure 2:
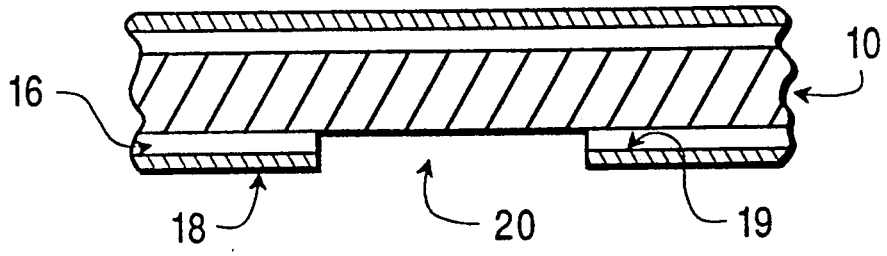
FIG. 2 is a sectional view of the airplane skin, maskant and plastic film, and the areas of the maskant and film removed from the inside surface.

In accordance with the invention, the process includes the step of selectively removing the plastic film and maskant from areas of the inside surface where chemical milling is desired. As depicted herein and embodied in FIGS. 2 and 3, step C, plastic film 18 and maskant 16 are selectively removed from areas 20 on inside surface 12.

The final shape of the workpiece dictates the removal of the maskant and film. The actual removal can be accomplished by conventional means, such as stripping. Although the present embodiment contemplates etching of only the inside surface of the workpiece, the invention should not be limited to this.

In accordance with the invention, the process includes the step of immersing the skin in a chemical bath for etching the areas of the inside surface not covered by the plastic film and maskant. As depicted herein and embodied in FIG. 3, step D, the skin 10 is immersed in a chemical bath (not shown) for etching the areas 20 of inside surface 12 not covered by plastic film 18 and maskant 16.

A variety of chemical etching solutions are appropriate. The actual depth of the etched areas is governed by the milling rate. The milling rate is determined by measuring the amount of metal removed during a certain treatment time.

In accordance with the invention, the process includes the step of removing the plastic film and maskant from both the inside and outside surfaces. As depicted herein and embodied in FIG. 3, step E, after etching plastic film 18 and maskant layers 16 are removed from both inside and outside surfaces 12, 14.

After the skin 10 has been milled to its desired configuration, the remaining maskant 16 and plastic film 18 are removed. The finished workpiece can then be polished or anodized, etc. to permanently protect the finish if desired.

In accordance with another embodiment of the invention, a process for chemically milling a component having inside and outside surfaces, comprising the step of applying a maskant layer to one of the inside or outside surfaces of the component. As depicted herein and embodied in FIG. 4, step A', a maskant layer 16 is applied to one of the outside or inside surfaces 12, 14.

Figure 4:
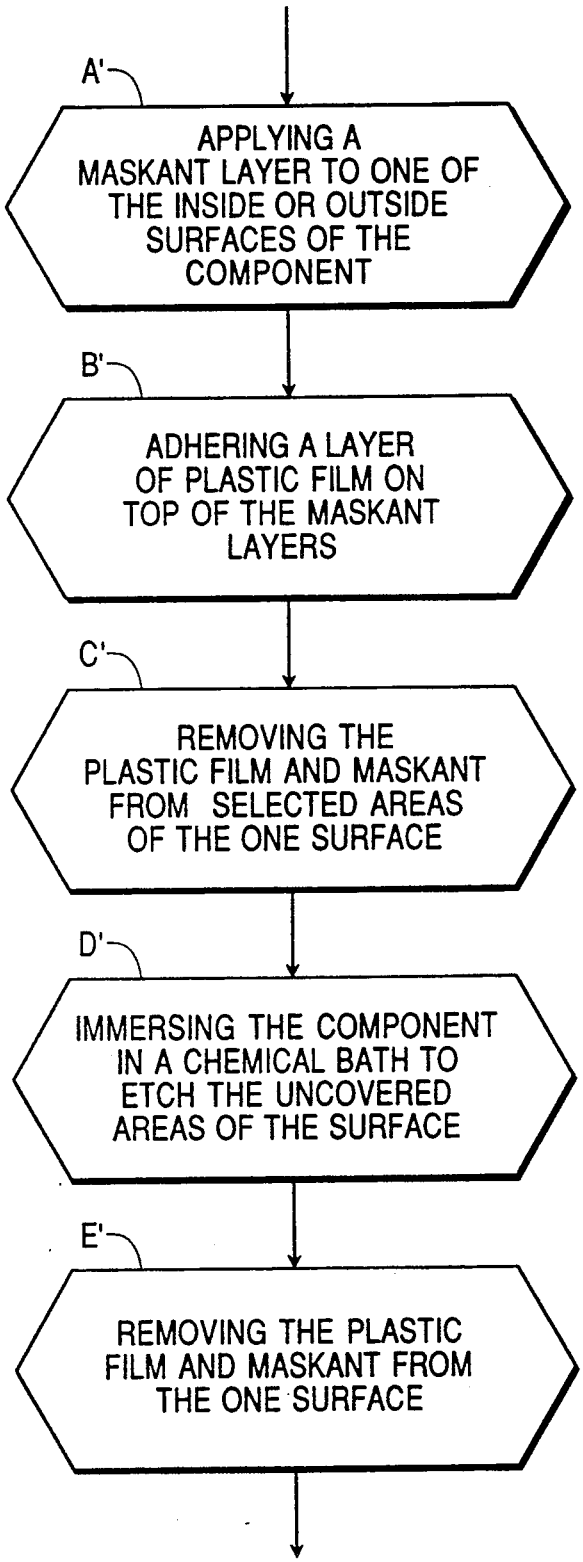
FIGS. 4(A′–E′) show a flow diagram of an alternative process of the present invention.

As depicted in FIG. 4, step B', a layer of plastic film 18 is then adhered on top of the maskant layer 16. As depicted in step C' the plastic film and maskant are selectively removed from areas of the surface where chemical milling is desired. As in the first embodiment the component is immersed in a chemical bath for etching the areas of the surface not covered by the plastic film and maskant, as shown in step D'. Finally, the plastic film and maskant are removed from the inside or outside surface.

It will be apparent to those skilled in the art that various modifications and variations could be made to the process of the invention without departing from the scope o spirit of the invention.

What is claimed is:

1. A process for chemically milling an airplane skin having inside and outside surfaces, comprising the steps of:

applying a maskant layer to at least one of the inside and outside surfaces of the skin;

adhering a layer of plastic film on top of the maskant layer;

selectively removing the plastic film and maskant from areas of the masked surface where chemical milling is desired;

immersing the skin in a chemical bath for etching the areas of the masked surface not covered by the plastic film and maskant; and removing the plastic film and maskant from the masked surface.

2. The process of claim 1 wherein the adhering step comprises covering the maskant with said plastic film and applying heat and pressure to said skin to further bond said plastic film to said maskant.

3. The process of claim 1 wherein the plastic film has one bondable side disposed adjacent the maskant layer

4. The process of claim 1 wherein the plastic film is polytetrafluoroethylene.

5. In a process for chemically milling a component having surfaces wherein a maskant is applied to the surfaces, cured, and selectively removed in predetermined areas prior to immersion in a chemical bath, the improvement comprising the steps of:

adhering a plastic film on top of the maskant layer on each surface; and selectively removing the plastic film only in the predetermined areas prior to said immersion.

6. The process of claim 6 wherein the plastic film is polytetrafluoroethylene.

7. A process for chemically milling a component having inside and outside surfaces, comprising the steps of:

applying a maskant layer to one the inside or the outside surfaces of the component;

adhering a layer of plastic film on top of the maskant layer;

selectively removing the plastic film and maskant from areas of the surface where chemical milling is desired;

immersing the component in a chemical bath for etching the areas of the surface not covered by the plastic film and maskant; and removing the plastic film and maskant from the inside or outside surface.

* * * * *